US005918531A

United States Patent [19]

Oh

[11] Patent Number: 5,918,531

[45] Date of Patent: Jul. 6, 1999

[54] CONNECTING ROD AND PISTON COUPLING STRUCTURE OF COMPRESSOR

[75] Inventor: Il-Kyo Oh, Suwon, Rep. of Korea

[73] Assignee: Samsung Electronics Co., Ltd., Suwon, Rep. of Korea

[21] Appl. No.: 08/951,324

[22] Filed: Oct. 16, 1997

[30] Foreign Application Priority Data

Nov. 8, 1996 [KR] Rep. of Korea ..... 96-52851

[51] Int. Cl.[6] ..... B01D 47/00

[52] U.S. Cl. ..... 92/187; 417/455

[58] Field of Search ..... 92/187; 74/579 E; 417/415

[56] References Cited

U.S. PATENT DOCUMENTS 3,857,976 12/1974 Whorter ..... 92/187 X 5,485,777 1/1996 Kim ..... 92/187 X 5,499,571 3/1996 Dreiman ..... 92/187

FOREIGN PATENT DOCUMENTS 299688 3/1972 U.S.S.R. ..... 92/187

*Primary Examiner*—Hoang Nguyen

*Attorney, Agent, or Firm*—Burns, Doane, Swecker & Mathis, L.L.P.

[57] ABSTRACT

Connecting rod and piston coupling structure of a compressor by which the working efficiency is increased by simplification of assembling operation and abrasion is reduced between a piston and a cylinder bore, the structure comprising a plane section of the piston to refrain the connecting rod from being protruded out of the piston and to get a small diameter part of the connecting rod to be placed thereon, and a round-shaped protruded circulating shaft perpendicularly extended from the plane section of the piston and formed to be inserted into a small diameter part hole of the connecting rod.

2 Claims, 3 Drawing Sheets

CONNECTING ROD AND PISTON COUPLING STRUCTURE OF COMPRESSOR

BACKGROUND OF THE INVENTION

1. Field of the Invention

The present invention relates to a combining structure of a compressor, and more specifically to connecting rod and piston coupling structure in a compressor.

2. Description of the Prior Art

Generally, a compressor is an apparatus for applying pressure on fluid to properly change pressure and temperature, etc., to meet a desired purpose. The compressor is usually classified into swash plate type, piston-type and the like according to an operational process. As shown in FIG. 3, the piston-type compressor comprises a housing(50) to a stator(51) fixed in the housing(50), a rotor(52) disposed in the stator(51) for rotation therein, and a crankshaft(54) forcibly inserted into the rotor(52) and having an eccentric shaft(53) at one end thereof, a connecting rod(58) having the eccentric shaft(53) inserted into one end thereof and a piston(57) sliding in a bore(56) of a cylinder block(55) inserted into the other end thereof, and a cylinder head(60) coupled via the cylinder block(55) and a valve assembly (59).

As shown in FIG. 4, the connecting rod(58) and the piston(57) are combined by a specific structure comprising the connecting rod(58) including a small diameter hole(62) at an opposite side from a large diameter hole(61) formed for the crankshaft(54), a pin hole(64) formed at the piston(57) to get matched to the small diameter hole(62) along with a fixing hole(63) for the small diameter hole(62), a piston pin(65) for the pin hole(64), and the fixing pin hole(67) oppositely formed from the piston pin(65) and the piston(57) for accepting the fixing pin(66).

In other words, the small diameter part of the connecting rod(58) is inserted into the fixing hole(63) of the piston(57), and the piston pin(65) is then inserted into both the pin hole(64) and the small diameter hole(62). The connecting rod(58) and the piston(57) with the piston pin(65) are secured tightly by the fixing pin(66) inserted into the fixing pin hole(67) to prevent the piston pin(65) from falling out of the piston(58).

SUMMARY OF THE INVENTION

As seen from the above, there is a problem of complexity in construction and decrease in working efficiency of assembly performance in that, a piston pin and a fixing pin are inserted respectively into a piston pin hole and a fixing pin hole to combine a connecting rod and a piston. Therefore, the present invention is provided to solve the aforementioned problem and it is an object of the present invention to provide a connecting rod and piston coupling structure of a compressor by which coupling of piston to connecting rod is simplified to thereby increase an assembly efficiency, the structure comprising: a plane section formed at the piston for placing a small diameter part of the connecting rod and for the connecting rod not to be protruded from the piston; and a round shaped protruded circulating shaft for being protruded to the plane section and for getting into the small diameter part of the connecting rod.

BRIEF DESCRIPTION OF THE DRAWINGS

For fuller understanding of the nature and objects of the invention, reference should be made to the following description taken in conjunction with the accompanying drawings in which.

DETAILED DESCRIPTION OF THE INVENTION

Figure 1:
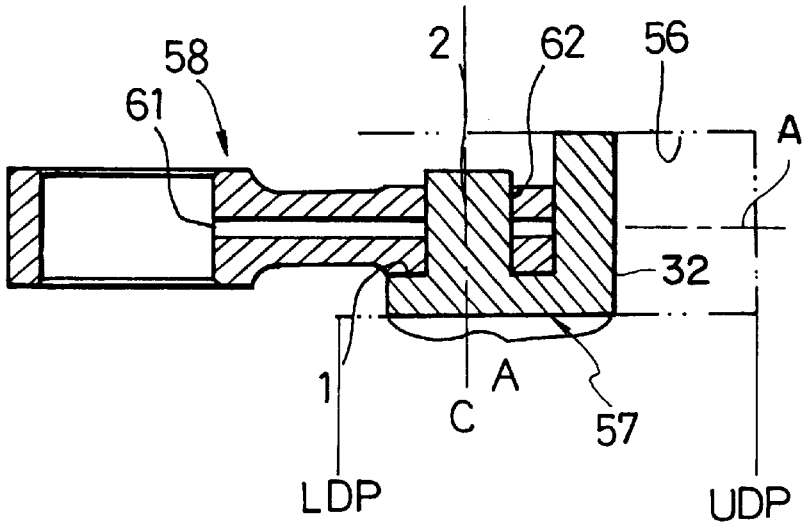
FIG. 1 is an enlarged sectional view for illustrating combination of a connecting rod and a piston in a compressor in accordance with the present invention.
Figure 2:
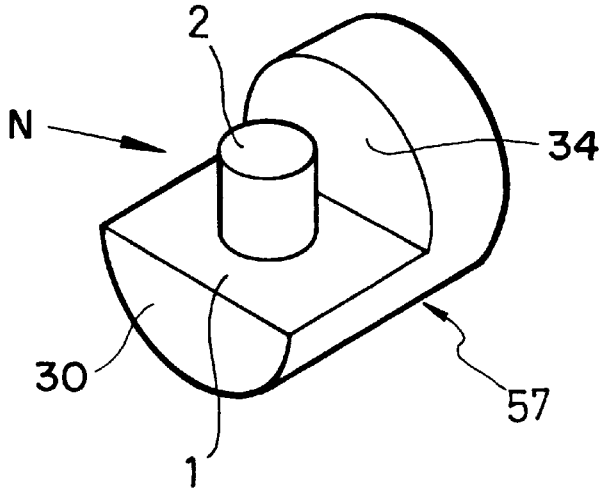
FIG. 2 is a perspective view of the piston shown in FIG. 1.
Figure 3:
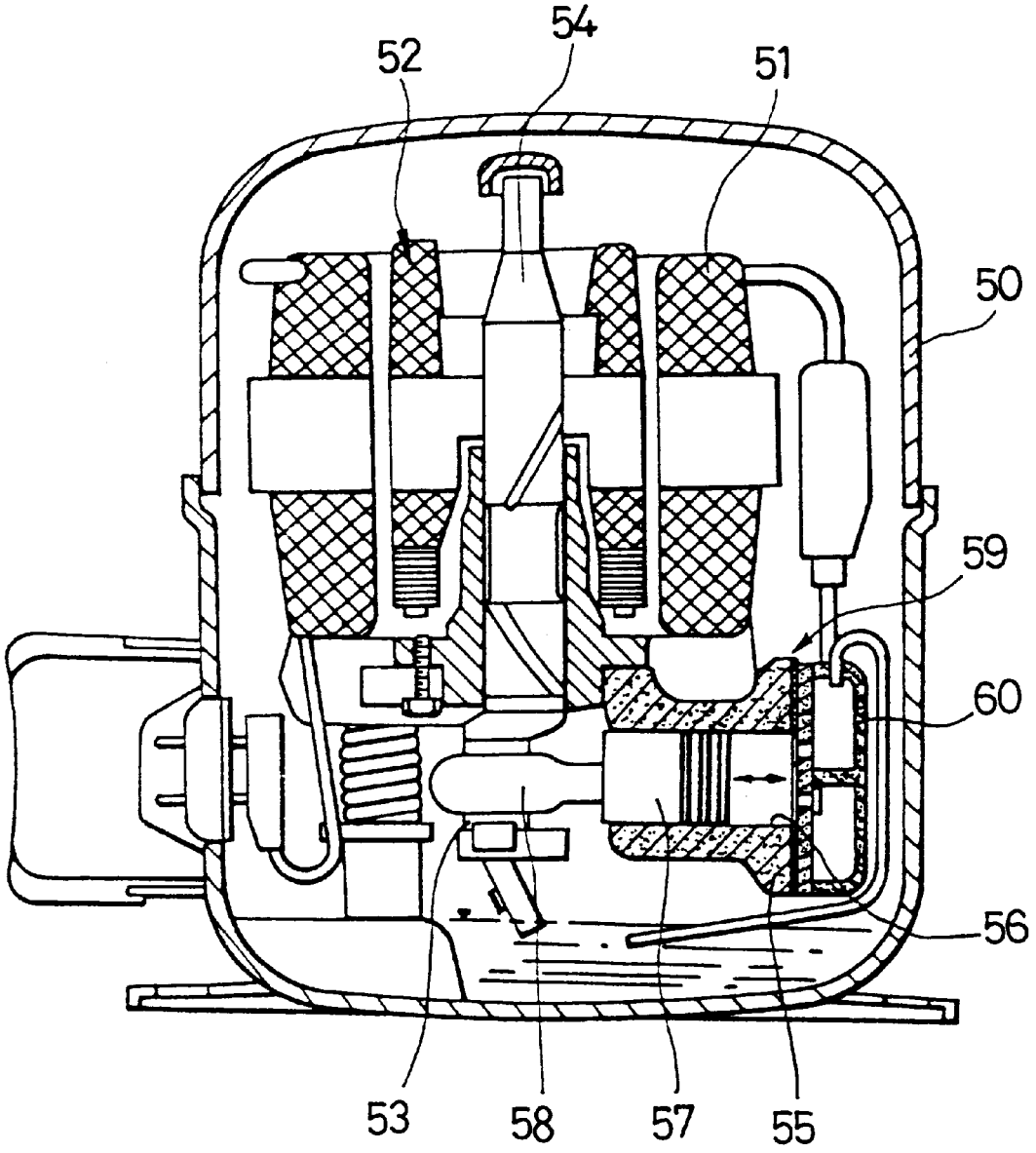
FIG. 3 (PRIOR ART)
FIG. 3 is a cross-sectional view of a conventional closed compressor.
Figure 4:
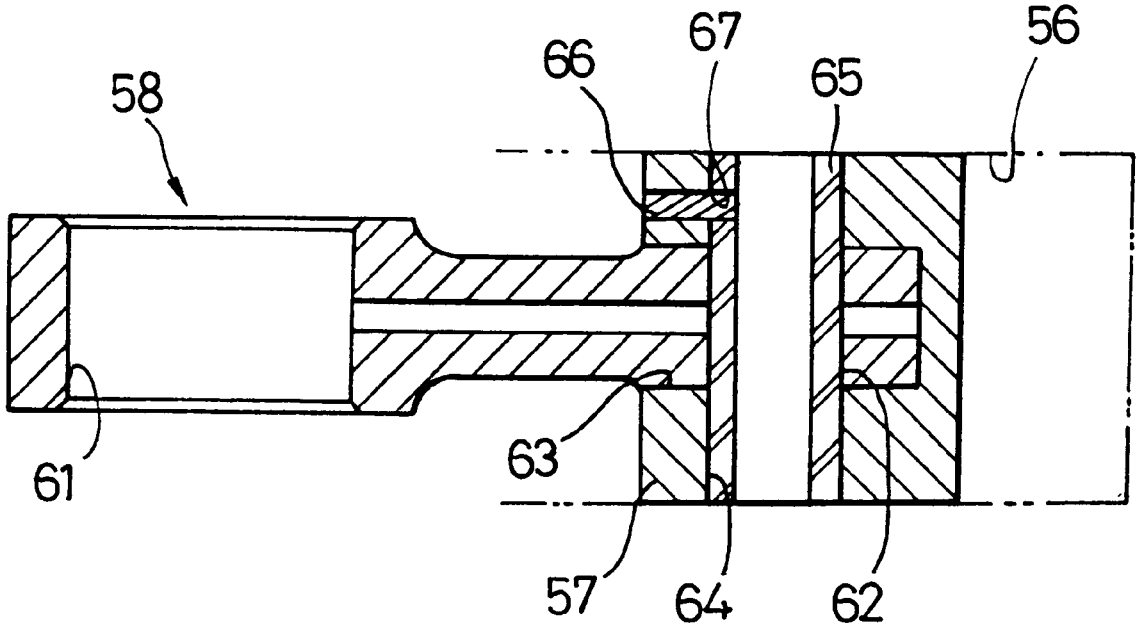
FIG. 4 (PRIOR ART)
FIG. 4 is a cross-sectional view for illustrating a combined state of the connecting rod and the piston shown in FIG. 3.

FIGS. 1 and 2 are detailed drawings for illustrating a combined structure of a connecting rod and a piston in a compressor according to the present invention, wherein the structure includes a plane surface of section (1) of a body piston (57), and a round-shaped protruded circulating shaft (2) for being protruded from the plane section. The plane surface (1) thus forms part of a notch N, the plane surface extending parallel to a center axis A of the body from a rear end (30) of the body and terminating short of a front end of the body. Thus, a front portion of the body disposed forwardly of the notch N includes a forwardly facing surface (32) and a rearwardly facing surface (34).

When the piston(57) is placed at the lower dead point (LDP), the circulating shaft(2) forms a predetermined height to prevent the piston(57) from falling out of a cylinder bore(56), which also prevents the connecting rod(58) and the piston(57) from being separated. Thus, if the circulating shaft(2) is inserted into a small diameter hole(62) of the connecting rod(58), it plays the same role to support rotation of the piston as that of a conventional piston pin(65). In addition, the diameter of the circulating shaft(2) should be formed to bear the turning effect of the connecting rod(58) which is sent into the piston(57).

According to the present invention, the connecting rod is seated on the surface (1) whereby the small diameter hole (62) receives the circulating shaft(2) formed as part of the body of the piston(57), as can be seen from the cross-hatching of the piston in FIG. 1, and then the piston is inserted into the cylinder bore(56).

As described above, insertion of the piston(57) into the cylinder bore(56) results in combining a large diameter hole(61) of the connecting rod(58) with a crankshaft(54). Therefore, assembling process of the piston is substantially simplified by two steps, wherein the circulating shaft(2) is inserted into the small diameter hole(62) of the connecting rod(58) and the crankshaft(54) is placed into the large diameter hole(61).

When the compressor is in operation, the crankshaft(54) rotates and then the piston(57) aligned with the connecting rod(58) is reciprocating in the cylinder bore(56). Reciprocation of the piston(57) causes absorption and compression of outside air. When the piston is moving between the upper dead point(UDP) and the lower dead point(LDP), the center line C of the circulating shaft(2) does not deviate from the LDP, which refrains the connecting rod(58) from falling out of the circulating shaft(2). As a result, the connecting rod(58) is not separated from the piston(57) by preventing the connecting rod from falling out of the cylinder bore(56).

Particularly, if a plane section(1) is made by cutting out one part of the piston(57), it brings an effect that only one part (A) of the piston is compressed in tension, resulting in reducing a frictional area between the cylinder bore(56) and the piston(57). Accordingly the frictional area between the cylinder bore(56) and the piston(57) is minimized to reduce energy loss and/or wear caused by frictional movement. In other words, the frictional area between the cylinder bore (56) and the piston(57) is decreased as large as the size of plane section(1), as described above, whereby heat is less generated and abrasion is much reduced.

As described above, there are advantages in the present invention, in that simplification of the assembling process and reduction of abrasion between the piston and the cylinder bore can be accomplished, since the piston and the connecting rod are combined only by the circulating shaft formed in the plane section of the piston.

What is claimed is:

1. Connecting rod and piston coupling structure of compressor, the structure comprising:

a plane section of a piston body arranged to prevent a connecting rod from being protruded out of the piston body and to support a small diameter part of the connecting rod thereon; and a circulating shaft perpendicularly extended from the plane section of the piston body and inserted into a small diameter hole of the connecting rod, the circulating shaft being a part of the piston body.

2. In combination, a connecting rod and a piston mounted thereon, wherein:

the connecting rod includes a hole at one end thereof;

the piston comprising a generally cylindrical piston body having:

front and rear ends spaced apart along a longitudinal center axis of the piston body, a notch formed in a rear portion of the piston body, the notch including a substantially planar first surface extending from the rear end parallel to the center axis and terminating short of the front end, whereby a front portion of the piston body disposed forwardly of the notch includes a forwardly facing second surface and a rearwardly facing third surface, the third surface intersecting the first surface, and a circulation shaft extending substantially perpendicularly from the first surface and spaced rearwardly from the third surface, the circulation shaft being a part of the piston body;

the connecting rod being seated on the first surface, with the circulation shaft extending through the hole to join the piston to the connecting rod.

* * * * *